US007545948B2

(12) United States Patent
Fradin

(10) Patent No.: US 7,545,948 B2
(45) Date of Patent: Jun. 9, 2009

(54) LOUDSPEAKER

(76) Inventor: Bernard Fradin, 2 route du Boisdu Pont, 44350 Guérande (FR)

( * ) Notice: Subject to any disclaimer, the term of this patent is extended or adjusted under 35 U.S.C. 154(b) by 587 days.

(21) Appl. No.: 11/143,195

(22) Filed: Jun. 1, 2005

(65) Prior Publication Data

US 2006/0256998 A1 Nov. 16, 2006

(51) Int. Cl.
*H04R 25/00* (2006.01)

(52) U.S. Cl. ..... 381/394; 381/431; 381/152; 381/396; 381/398; 381/191

(58) Field of Classification Search ..... 381/152, 381/431, 394, 396, 151, 398, 191
See application file for complete search history.

(56) References Cited

U.S. PATENT DOCUMENTS

| | | | | |
|---|---|---|---|---|
| 4,354,067 | A | 10/1982 | Yamada et al. | 179/146 |
| 4,495,638 | A | 1/1985 | Yamada et al. | 381/27 |
| 4,750,208 | A | 6/1988 | Yamada et al. | |
| 6,618,487 | B1 * | 9/2003 | Azima et al. | 381/152 |
| 7,062,064 | B2 * | 6/2006 | Bachmann et al. | 381/431 |
| 7,369,674 | B2 * | 5/2008 | Miura | 381/401 |
| 7,372,968 | B2 * | 5/2008 | Buos et al. | 381/152 |
| 2002/0027999 | A1 | 3/2002 | Azima et al. | 381/431 |

FOREIGN PATENT DOCUMENTS

| | | |
|---|---|---|
| EP | 92300854 | 8/1993 |
| GB | 1123524 | 8/1968 |
| JP | 58218296 | 12/1983 |
| WO | WO 00/33612 | 6/2000 |

* cited by examiner

*Primary Examiner*—Suhan Ni
*Assistant Examiner*—Jasmine Pritchard
(74) *Attorney, Agent, or Firm*—Lumen Patent Firm

(57) ABSTRACT

This invention discloses a loudspeaker 100 that includes a casing 110, a drive assembly 111 with a magnetic core 112, and an induction (voice) coil 113 attached to a first rigid plate 114 for the transmission of vibrations to a support 300. The first rigid plate 114 is attached to the casing 110 by a second plate 115 used for the suspension and the radial positioning of the voice coil 113, and elastic studs 116, used for the elastic suspension of the first rigid plate 114 in relation to the casing 110. By virtue of the invention a room can be transformed easily into an auditorium.

27 Claims, 2 Drawing Sheets

LOUDSPEAKER

FIELD OF THE INVENTION

The invention concerns the area of loudspeakers and acoustic enclosures employed as acoustic transducers. In particular, the invention concerns loudspeakers equipping, for example, domestic high-fidelity equipment, audio equipment in theatres, and radio equipment fitted in automobiles.

BACKGROUND

In order to reproduce acoustic ambience over a wide range of frequencies with adequate fidelity and power, the choice of loudspeakers must take into account the conditions relating to their attachment and their installation.

A loudspeaker generally includes a motor, or drive mechanism, and a membrane or cone driven by the drive assembly so that it vibrates in order to reproduce sound over a certain band in the audio-frequency range, between 30 and 16000 Hertz. The assembly is held together and protected by a frame structure or basket assembly.

The membrane for the loudspeaker is generally circular. It is attached by its edge to the basket, and is driven at its centre by the coil of the drive assembly, causing it to vibrate, preferably at a frequency (F) corresponding to a vibration that has an antinode at the centre and a node at its perimeter, the distance between the antinode and the node being at least a quarter of the wavelength (λ) of the vibration.

It can be shown that the diameter (D) of the membrane corresponds to the vibration frequency (F) of the wavelength (λ) such that:

$$D=c/2*F=\lambda/2$$

where c is the speed of sound.

To increase the bandwidth of the membrane around frequency F, a non-resonant material, such as paper, is employed for the membrane, and in addition the latter is molded so that it has ridges at its periphery in order to isolate it as well as possible from the flare of the basket and to smooth out the position of the nodes.

To cover a wide range of frequencies, it is also necessary to resort to loudspeakers of different diameters (D1, D2, etc.) corresponding to centre frequencies F1, F2, etc. This leads to the design of loudspeakers known as tweeters (D<8 cm), mid-range (8 cm<D<16 cm), bass or woofers (16 cm<D<25 cm), and subwoofers (D>25 cm). Finally, to reduce the volume of these loudspeakers, they have to be mounted coaxially.

Moreover, and independently of the installation conditions, it is necessary to ensure that the whole range of frequencies thus covered by means of a multiplicity of loudspeakers is distributed throughout the listening volume, such as a living room or an office used as an auditorium, possibly in stereo thus doubling the number of loudspeakers or enclosures necessary. It is this distribution problem that is surmounted by the invention, as will be shown below.

Oddly enough, it was not this problem that the inventor was trying to solve, but rather a different problem, which arose in the very different context of creating a vibrating physical-therapy appliance for use in the medical area, with the opposite function to a stethoscope, and employed to treat internal organs that had developed mechanical malfunctions (incontinence, constipation, etc.).

To solve the medical problem, the inventor had the idea of drawing upon expertise developed at least twenty-five years ago but abandoned at the time, relating to the problem of vibration-diffusion. The solution concerned what one could describe as a loudspeaker with no membrane or cone.

This loudspeaker had an electromagnetic drive assembly with a cylindrical magnetic core and a voice coil surrounding the core and attached to a set of two plates—a flexible, centering suspension plate ensuring the radial positioning of the coil around the core while also allowing the axial vibration of the coil, and a rigid plate designed to be fixed, for example, to a wall of an auditorium. When this latter plate was attached, the wall replaced the membrane traditionally used in a loudspeaker. However, the output of the drive assembly and the acoustic quality of the loudspeaker were much too low. For a drive unit of 35 watts, the result was a sound of mediocre quality and very low level—some 60 dBA.

SUMMARY OF THE INVENTION

The invention concerns firstly a loudspeaker that does not contain a membrane, and which includes a casing; a motor including a magnetic core; and, around the core, an induction coil attached to a first rigid plate for the transmission of vibrations to a support, the first plate being attached to the casing through flexible suspension means including a second plate used for the suspension and radial positioning of the coil. The loudspeaker is characterized by the fact that the suspension means are arranged to provide elastic suspension for the first rigid plate in relation to the casing.

A material is elastic when the force applied to the material and the displacements due to the resulting deformation of this material remain proportional. In particular, this linearity property favors the acoustic resonance of the material in response to a vibrating drive.

The device of previous design had a second, flexible, bakelite plate, bakelite being a material which, like the paper used for membranes, presents no acoustic or resonant quality and which, moreover, is not elastic. Since its purpose was to center the coil while also allowing the vibrations to propagate, it is unclear why it would have had this quality, especially given the risk of introducing an incidental parasitic resonance.

By virtue of the elasticity of the suspension of the rigid plate to the casing in the present invention, the vibrations generated by the coil propagate more freely between the drive assembly and the plate or, more precisely, between the plate and the motor.

It is preferable that the elastic suspension means should include elastic studs between the two plates.

In a preferred embodiment of the invention, the second plate, for radial positioning of the coil, is made from elastic material.

It is advantageous if the second plate is made from composite material, such as glass-fibre reinforced epoxy resin or reinforced carbon, or any other material capable of acoustic resonance.

It is also preferable that the second plate, containing a central part and a peripheral part, be provided with apertures that delimit the central and peripheral parts, and which are bounded by "hinged" bridges in order to endow them with the ability to vibrate in relation to each other.

In an embodiment of the invention that is very much preferred, the core of the coil has an axial symmetry, the two plates used for suspension and the transmission of vibrations are approximately perpendicular to the axis of the core, the elasticity of the suspension means is greatest along this axis, and the suspension plate is rigid in the direction perpendicular to this axis.

A loudspeaker of the invention attached to a wall, for example, and used with a drive assembly rated at 35 watts, results in an excellent, high quality sound level of 90 dBA.

The invention also concerns a wall forming an auditorium enclosure, to which is attached a multiplicity of loudspeakers according to the invention, designed to transmit their vibrations in respectively different frequency bands.

Finally, the invention also concerns a device for the administration of therapy through bodily vibrations, using a loudspeaker according to the invention.

BRIEF DESCRIPTION OF THE FIGURES

The invention will be understood better with the aid of the following description of two embodiments of the loudspeaker with no membrane according to the invention, in conjunction with the drawings, in which.

DETAILED DESCRIPTION OF THE INVENTION

Figure 1:
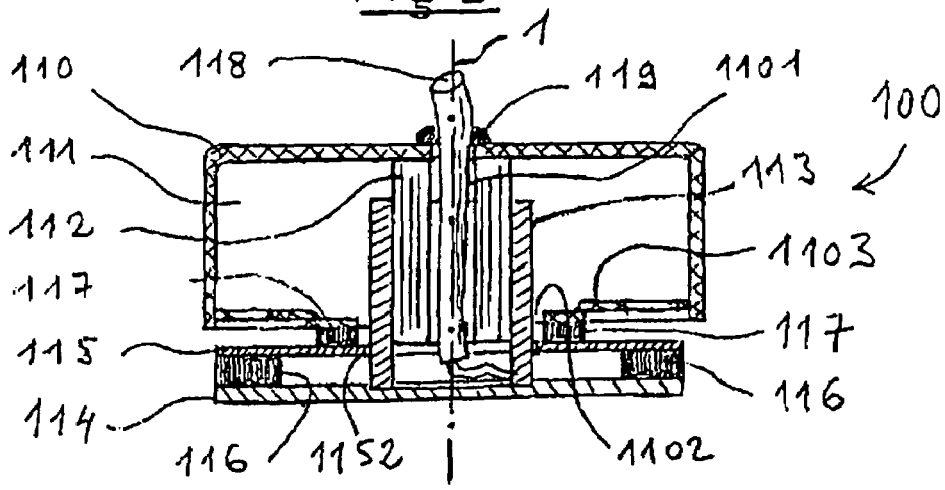
FIG. 1 is a view of an axial section of a first embodiment of the loudspeaker according to the invention.

With reference to FIG. 1, the loudspeaker 100 consists of a casing, here cylindrical casing 110 on axis 1, protecting a drive assembly 111. The drive assembly 111 includes a cylindrical magnetic core 112 on axis 1, attached to the casing 110 at its upper end. The upper end of the casing and the core are drilled out with a cylindrical coaxial bore to form hole 1101 to allow the passage of an electrical connecting cable 118. The cable 118 is attached to the casing through an elastic seal 119 with a wire through hole 1101 thus closing off the hole 1101.

The lower end 1103 of the casing 110 is drilled out with circular opening 1102 centered on axis 1, so as to allow the passage of an induction coil 113 that slides freely without contact along axis 1 over the length of the core 112, and that receives electrical signals representing sound by means of the connecting cable 118.

The coil 113 is free at its upper end, and is attached at its lower end to a first rigid plate 114, which is approximately square and perpendicular to axis 1. This plate 114 includes the means for attachment onto a support, not shown in this figure, but which will be described later. The plate 114 is a plate for the transmission of vibrations.

The plate 114 is also attached to the casing 110 by means of flexible and elastic suspension means that are used to hold the induction coil 113 in place in relation to the core 112, while also allowing it to vibrate under the action of the induction forces created by the electrical signals mentioned above.

These suspension means include a second plate 115 approximately parallel to the first plate 114, this second plate 115 being used for the suspension and the radial positioning of the coil, studs 116 for the elastic attachment of the first plate 114 to the second plate 115, and means for attachment 117 (120 in FIG. 2) of the second plate 115 to the casing 110. These means can be rubber studs 117, such as the studs 116 for the attachment of the two plates to each other.

To create the second plate 115, we used a card made from a composite material, glass-fiber reinforced epoxy resin, but we could have chosen reinforced carbon or any other material resulting in plane rigidity and a perfectly elastic axial behavior favoring acoustic resonance.

This card is arranged so as to be able to vibrate along axis 1 while still remaining rigid perpendicular to this axis, as will be explained later.

Figure 2:
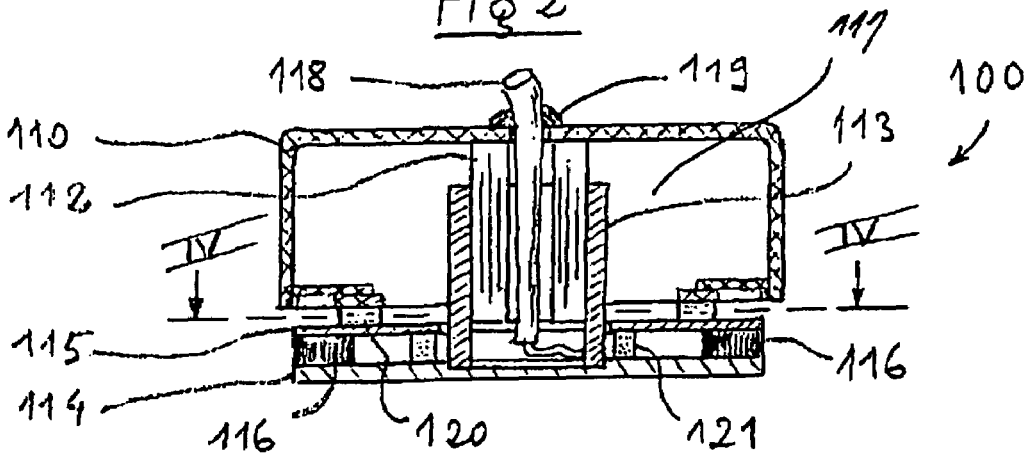
FIG. 2 is a view of an axial section of a second embodiment of the loudspeaker according to the invention.

The description above relates to the first embodiment of the invention, shown in FIG. 1. FIG. 2 represents a second embodiment of the invention, differentiated from this first embodiment (similar elements have the same references) only by the choice of a PVC ring 120 in place of the studs 117 and by the addition of a foam ring 121 between the two plates, used to isolate the motor 111 from the external environment and to limit the entry of dust particles between the core 112 and the coil 113.

Figure 3:
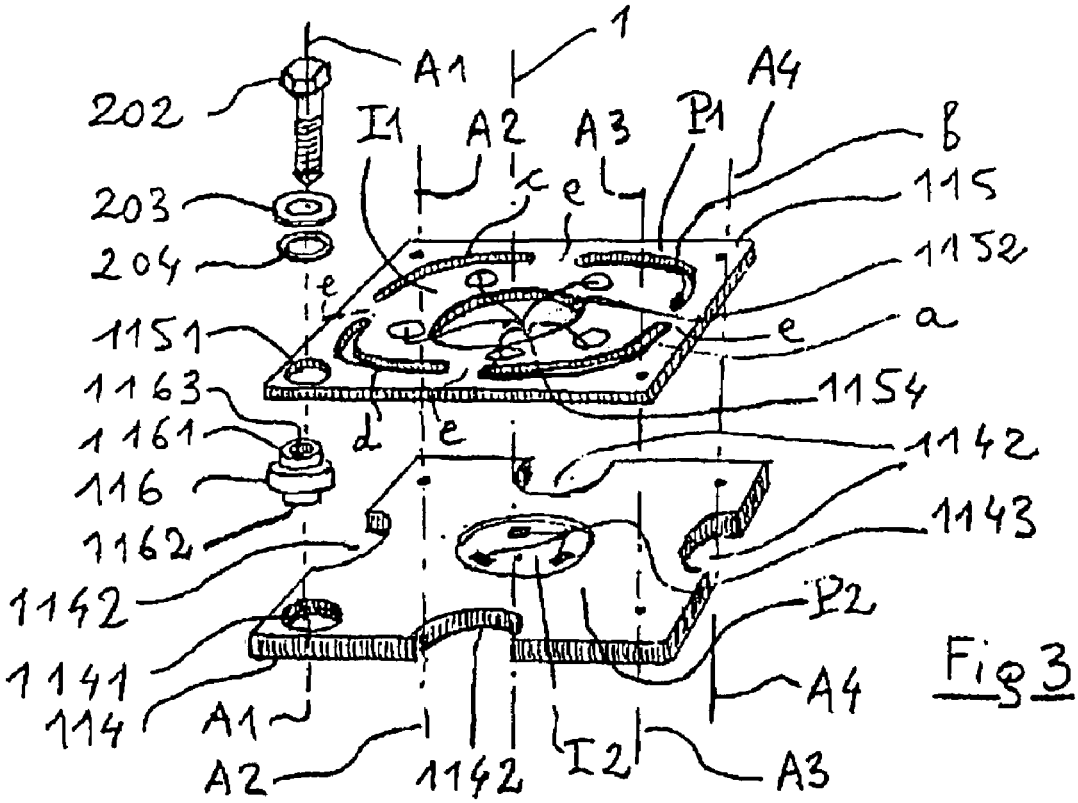
FIG. 3 is a view of an exploded perspective of the transmission and suspension plates fitted to the drive assembly of the loudspeaker, with a device for attachment to a wall, according to the invention.
Figure 4:
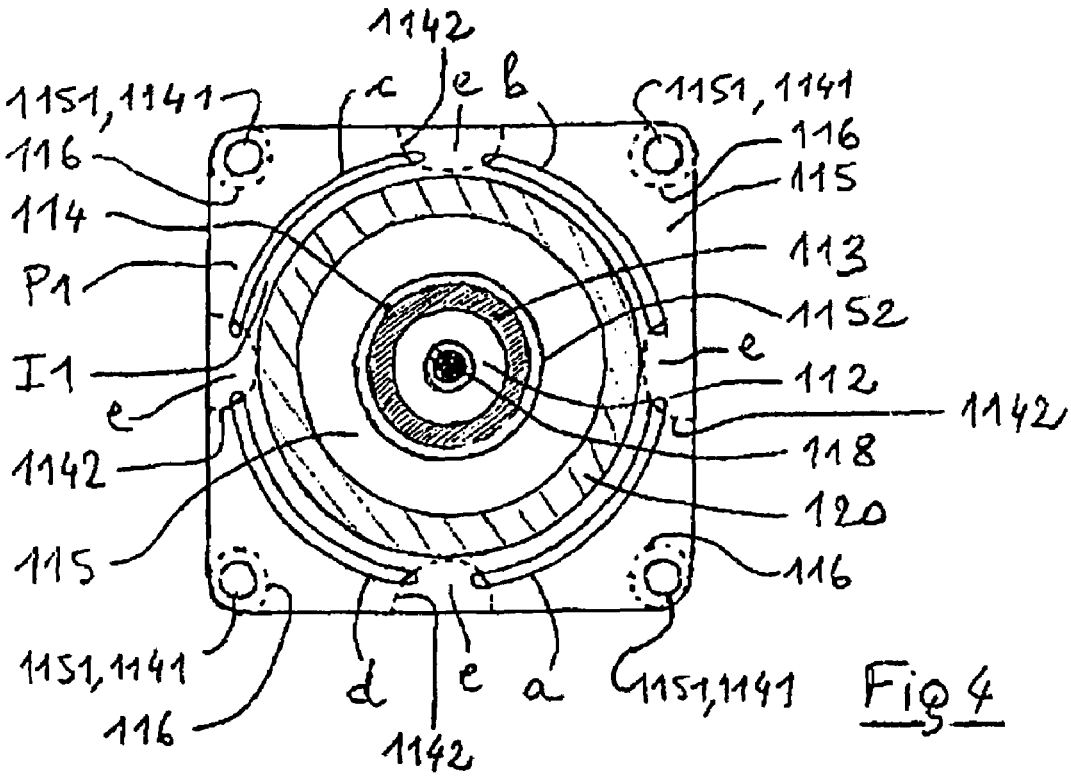
FIG. 4 is a view of a section, along line IV-IV, of the loudspeaker of FIG. 2, showing the plates as seen from above, without the attachment device, according to the invention.

The arrangement of the suspension means will now be described more precisely, with reference to FIGS. 3 and 4.

The second suspension plate 115, approximately of the same shape as the first plate 114, is drilled out with four quarter-circular slots a, b, c, d distributed on a common circle with axis 1, but which remain separated by bridges or linking zones acting as hinges to increase the elasticity of the plate 115. The slots a, b, c, d divide the plate 115 into a central part I1 and a peripheral part P1, which are capable, by virtue of the hinges, of vibrating in relation to each other along axis 1, but not in their plane.

The fixing studs 116 for attachment of the two plates 114 and 115 to each other are cylindrical, with their axes parallel to axis 1, are composed of rubber, and are glued and positioned at the four corners so as to be as far as possible from the hinges and where they interfere as little as possible with the elasticity of the hinges.

The elastic studs 117, also cylindrical and on an axis parallel to axis 1, are glued onto the central part I1 in regularly spaced positions 1154 (FIG. 3) facing the lower end of the casing 110, and are removable from this casing. These too can be made of rubber. The PVC ring 120 is glued onto the periphery of this central part I1 (FIG. 4) and onto the casing 110.

The coil 113 is held by feet (not shown) located in slots 1143 in the central part I2 of the transmission plate 114. These slots are used for correct centering of the coil.

It is also possible to have slots 1142 positioned symmetrically in axial symmetry to the periphery of the rigid transmission plate 114 in order to increase the bandwidth of the sound vibrations.

It can be seen that the attachment studs 116 are positioned on peripheries P1 and P2 of the second and first plates 115 and 114, respectively, in axial symmetry with axis 1, and that the studs 117 or the ring 120 are located between the central part I1 of the second plate 115 and the casing 110 in such a manner that only the hinges mechanically connect the casing 110 to the first plate 114. This provides the first transmission plate 114 with the ability to vibrate in relation to the casing 110 along axis 1, so that when the plate 114 is fixed to a wall and electrical signals are sent in the coil 113 fixed to the plate 114, it is the core 112, and therefore the drive assembly 111 and its casing 110, that vibrate in relation to the wall, which then acts as an acoustic enclosure.

A loudspeaker of this type, equipped with a 35-watt drive assembly, thus provides high-quality sound at a level of 90 dBA.

We have described suspension resources in the form of studs 116 between the two plates 114 and 115. Naturally, it is also possible to envisage the placement of springs or other elastic resources between these two plates.

The attachment to a wall 300 will now be explained, with reference to FIGS. 3 and 5.

It is possible to fix the first transmission plate 114 to the wall 300 using two different means of attachment devices in particular.

The first consists of an attachment that allows the plate 114 to be attached directly to the surface of the wall 300. In this case, a set of screws 202 (FIG. 3) passes through the studs 116 and the two plates 114 and 115 along axes A1, A2, A3 and A4.

To this end, the studs 116 are each drilled out with a hole 1163 along its axis, and the plates 114 and 115 are drilled with four holes 1141 and 1151 along axes A1, A2, A3 and A4, each to allow the passage of a screw 202, here of the hexagonal headed type. The heads of the screws 202 hold the plate 115 by means of a washer 203 and an elastic o-ring 204, as shown in FIG. 3.

In addition, the studs 116 have shoulders 1161 and 1162 cut to the diameters of the holes 1151 and 1141 in the plates 115 and 114, both of which are less than the external diameter of the studs 116, which enables them to hold the two plates 114 and 115 parallel and at a predetermined distance. Thus, the studs 116 act as spacers.

To fix the loudspeaker to the wall, an ordinary assembly device, which is not shown, is used to remove the lower end 1104 of the casing 110, which remains fixed to the elastic suspension plate 115. By means of a hole 1103 made in this lower end 1104 to provide access to the head of the screw 202, the screw 202 is inserted on each of the axes A1, A2, A3 and A4 into the wall 300, and the casing 110 is then refitted to its lower end 1104, using the same assembly device mentioned above.

Figure 5:
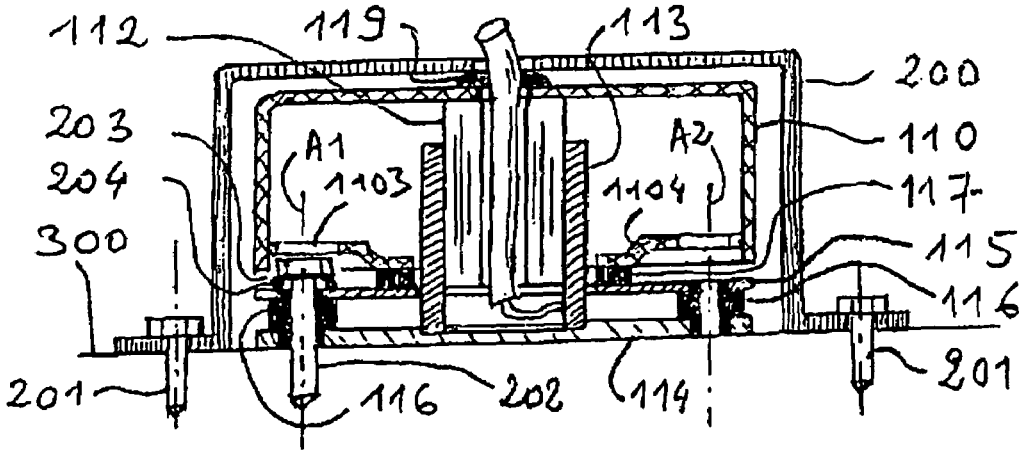
FIG. 5 is a diagram showing the mounting onto a support surface of a loudspeaker drive assembly according to the invention.

The second method, also illustrated in FIG. 5, consists of a bracket 200 secured by screws 201 to the wall 300, and holding the casing 110 against the wall 300. When screwed in, it presses elastically onto the seal 119 and holds the casing 110 in a sufficiently flexible manner so that it is not prevented from vibrating in relation to the wall 300.

These two methods of attachment can also be used simultaneously.

The invention not only enables one to recover the volume which would otherwise be necessary to accommodate loudspeaker enclosures in an auditorium, it also enables one to create a perfect ambience, since the sound is emitted by the very walls of the auditorium, with the walls themselves acting as the acoustic enclosures. Moreover, several loudspeakers, covering different frequency bands, can be fixed to the walls to further enhance the ambience of the space. In general, the invention allows any room to be transformed easily into an auditorium.

What is claimed is:

1. A loudspeaker, comprising:

(a) a casing; and (b) a motor with a cylindrical core, wherein said core is surrounded by an induction coil, wherein said induction coil abuts a first rigid plate, wherein said induction coil is fixedly attached to said first rigid plate about a center axis normal to said first rigid plate for transmission of vibrations to a support, wherein said first plate is attached to said casing through a flexible suspension means, wherein said flexible suspension means comprises a generally planar second suspension plate for suspension and radial positioning of said coil, wherein a bottom of said cylindrical magnetic core abuts said planar second suspension plate, and wherein said flexible suspension means provides elastic suspension for said first rigid plate in relation to said casing.

2. The loudspeaker as set forth in claim 1, wherein said flexible suspension means comprises elastic studs situated between said second suspension plate and said first rigid plate.

3. The loudspeaker as set forth in claim 2, wherein said second suspension plate includes a central part (I1) and a peripheral part (P1), wherein said first rigid plate includes a central part (I2) and a peripheral part (P2), wherein said elastic studs are attached at said peripheral parts (P1, P2) of said plates, and wherein studs for attachment of said second suspension plate to said casing are attached at said central part (I1) of said second suspension plate.

4. The loudspeaker as set forth in claim 1, wherein said second suspension plate for radial positioning of said coil is made from elastic material.

5. The loudspeaker as set forth in claim 4, wherein said second suspension plate is made from a composite material.

6. The loudspeaker as set forth in claim 5, wherein said material of said suspension plate is chosen from the group consisting of glass-fiber reinforced epoxy resin and reinforced carbon.

7. The loudspeaker as set forth in claim 1, wherein said second suspension plate includes a central part (I1) and a peripheral part (P1), wherein said second suspension plate is provided with apertures that delimit said central (I1) and said peripheral (P1) parts, and wherein said central (I1) and said peripheral (P1) parts are separated by hinge bridges in order to endow them with the ability to vibrate in relation to each other.

8. The loudspeaker as set forth in claim 1, wherein said cylindrical magnetic core of said coil has an axial symmetry, wherein said first rigid plate and said second suspension plate are approximately perpendicular to the axis of said core, wherein said elasticity of said suspension means is greatest along said axis, and wherein said second suspension plate is rigid in a direction perpendicular to said axis.

9. The loudspeaker as set forth in claim 3, wherein said peripheral part (P2) of first rigid plate includes slots in order to increase bandwidth of sound vibrations.

10. A wall forming an auditorium enclosure comprising a plurality of loudspeakers fixed to said wall, wherein said loudspeakers transmit vibrations in different frequency bands, and wherein said loudspeakers comprise:

(a) a casing; and (b) a motor with a cylindrical magnetic core, wherein said core is surrounded by an induction coil, wherein said induction coil abuts a first rigid plate , wherein said induction coil is fixedly attached to said first rigid plate about a center axis normal to said first rigid plate for transmission of vibrations to a support, wherein said first plate is attached to said casing through a flexible suspension means, wherein said flexible suspension means comprises a generally planar second suspension plate for suspension and radial positioning of said coil, wherein a bottom of said cylindrical magnetic core abuts said planar second suspension plate, and wherein said flexible suspension means provides elastic suspension for said first rigid plate in relation to said casing.

11. The wall as set forth in claim 10, wherein said flexible suspension means comprises elastic studs situated between said second suspension plate and said first rigid plate.

12. The wall as set forth in claim 11, wherein said second suspension plate includes a central part (I1) and a peripheral part (P1), wherein said first rigid plate includes a central part (I2) and a peripheral part (P2), wherein said elastic studs are attached at said peripheral parts (P1, P2) of said plates, and wherein studs for second suspension plate to said casing are attached at said central part (I1) of said second suspension plate.

13. The wall as set forth in claim 10, wherein said second suspension plate for radial positioning of said coil is made from elastic material.

14. The wall as set forth in claim 13, wherein said second suspension plate is made from a composite material.

15. The wall as set forth in claim 14, wherein said material of said suspension plate is chosen from the group consisting of glass-fiber reinforced epoxy resin and reinforced carbon.

16. The wall as set forth in claim 10, wherein said second suspension plate includes a central part (I1) and a peripheral part (P1), wherein said second suspension plate is provided with apertures that delimit said central (I1) and said peripheral (P1) parts, and wherein said central (I1) and said peripheral (P1) parts are separated by hinge bridges in order to endow them with the ability to vibrate in relation to each other.

17. The wall as set forth in claim 10, wherein said cylindrical magnetic core of said coil has an axial symmetry, wherein said first rigid plate and said second suspension plate are approximately perpendicular to the axis of said core, wherein said elasticity of said suspension means is greatest along said axis, and wherein said second suspension plate is rigid in a direction perpendicular to said axis.

18. The wall as set forth in claim 12, wherein said peripheral part (P2) of first rigid plate includes slots in order to increase bandwidth of sound vibrations.

19. A therapeutic device to provide vibrations to a body, comprising a loudspeaker, wherein said loudspeaker comprises:

(a) a casing; and (b) a motor with a cylindrical magnetic core, wherein said core is surrounded by an induction coil, wherein said induction coil abuts a first rigid plate wherein said induction coil is fixedly attached to said first rigid plate about a center axis normal to said first rigid plate for transmission of vibrations to a support, wherein said first plate is attached to said casing through a flexible suspension means, wherein said flexible suspension means comprises a generally planar second suspension plate for suspension and radial positioning of said coil, wherein a bottom of said cylindrical magnetic core abuts said planar second suspension plate, and wherein said flexible suspension means provides elastic suspension for said first rigid plate in relation to said casing.

20. The therapeutic device as set forth in claim 19, wherein said flexible suspension means comprises elastic studs situated between said second suspension plate and said first rigid plate.

21. The therapeutic device as set forth in claim 20, wherein said second suspension plate includes a central part (I1) and a peripheral part (P1), wherein said first rigid plate includes a central part (I2) and a peripheral part (P2), wherein said elastic studs are attached at said peripheral parts (P1, P2) of said plates, and wherein studs for attachment of said second suspension plate to said casing are attached at said central part (I1) of said suspension plate.

22. The therapeutic device as set forth in claim 19, wherein said second suspension plate for radial positioning of said coil is made from elastic material.

23. The therapeutic device as set forth in claim 22, wherein said second suspension plate is made from a composite material.

24. The therapeutic device as set forth in claim 23, wherein said material of said suspension plate is chosen from the group consisting of glass-fiber reinforced epoxy resin and reinforced carbon.

25. The therapeutic device as set forth in claim 19, wherein said second suspension plate includes a central part (I1) and a peripheral part (P1), wherein said second suspension plate is provided with apertures that delimit said central (I1) and said peripheral (P1) parts, and wherein said central (I1) and said peripheral (P1) parts are separated by hinge bridges in order to endow them with the ability to vibrate in relation to each other.

26. The therapeutic device as set forth in claim 19, wherein said core of said coil has an axial symmetry, wherein said cylindrical magnetic first rigid plate and said second suspension plate are approximately perpendicular to the axis of said core, wherein said elasticity of said suspension means is greatest along said axis, and wherein said second suspension plate is rigid in a direction perpendicular to said axis.

27. The therapeutic device as set forth in claim 21, wherein said peripheral part (P2) of first rigid plate includes slots in order to increase bandwidth of sound vibrations.

* * * * *